US006294023B1

(12) United States Patent
Katagiri et al.

(10) Patent No.: US 6,294,023 B1
(45) Date of Patent: Sep. 25, 2001

(54) CURTAIN COATING APPARATUS AND METHOD

(75) Inventors: Yoshinobu Katagiri; Kazuhiro Oki, both of Minami-Ashigara; Yasushi Suga, Tokyo, all of (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/404,544

(22) Filed: Sep. 24, 1999

(30) Foreign Application Priority Data

Sep. 25, 1998 (JP) ..... 10-271427

(51) Int. Cl.[7] ..... B05D 1/40
(52) U.S. Cl. ..... 118/410; 118/DIG. 4; 427/420
(58) Field of Search ..... 118/410, 325, 118/636, 621, DIG. 4, 324; 427/420

(56) References Cited

U.S. PATENT DOCUMENTS 3,508,947 4/1970 Hughes et al. ..... 117/34
4,249,478 * 2/1981 Gruener ..... 118/DIG. 4
4,851,268 7/1989 Kozak ..... 427/420
5,340,616 * 8/1994 Amano et al. .

FOREIGN PATENT DOCUMENTS 2-277570 11/1990 (JP) ..... B05C/5/00
4-61951 2/1992 (JP) ..... B05C/5/00
8-89886 4/1996 (JP) ..... B05D/1/30

* cited by examiner

*Primary Examiner*—Brenda A. Lamb
(74) *Attorney, Agent, or Firm*—Sughrue, Mion, Zinn, Macpeak & Seas, PLLC

(57) ABSTRACT

Before the start of coating, a deflector receives a curtain of a coating liquid free-falling from a coating hopper in order to prevent a continuously-running web from being coated with the coating liquid. At the start of the coating, the deflector is moved relatively to the coating hopper, so that the coating liquid can start to be applied to the web. A receding part is formed at the end of the deflector.

13 Claims, 3 Drawing Sheets

CURTAIN COATING APPARATUS AND METHOD

BACKGROUND OF THE INVENTION

1. Field of the Invention

The present invention relates to a curtain coating apparatus and method, and more particularly to an apparatus and method for coating a continuously-running support (hereinafter referred to as a "web") with a variety of liquid compositions in a curtain coating method for use in the manufacture of photosensitive material film, photographic printing paper, magnetic recording tapes, information recording paper such as pressure sensitive paper and heat sensitive paper, presensitized offset plates, adhesive tapes, or the like.

2. Description of Related Art

In the curtain coating method, a curtain of coating liquid, free-falling from a coating hopper, impinges on a continuously-running web so that the web can be coated with the coating liquid. Since the curtain coating method prevents small bubbles from accompanying the web between the web and the coating liquid, the web can be coated at a high speed. In the curtain coating method, it is important to coat the web with the coating liquid at the uniform thickness from the beginning of coating in order to prevent a transport roll from becoming unclean due to the unsatisfactory drying of the thickly-coated part of the web and achieve the satisfactory coated surface.

To achieve this object, U.S. Pat. No. 3,508,947 discloses a method in which a rotatable or slidable deflector, which is provided on the route of the free-falling curtain of the coating liquid, is moved back from the route at the start of the coating. Until a stable curtain with a desired amount of liquid is formed at the start of the coating, the deflector is arranged in such a way as to block the curtain of the coating liquid. The blocked coating liquid flows down on the deflector and is received by a container. After the conditions for the stable curtain are met, the deflector is rotated or slid and is moved back from the flow-down route of the curtain. Consequently, the curtain is applied on the web.

In the coating method using the deflector, a pool of the coating liquid is formed at the upstream of the collision point where the curtain impinges on the deflector. When the deflector is moved back to start coating, the pool of the coating liquid is applied on the web and a thickly-coated part is formed on the web. It causes the transport roll to become unclean due to unsatisfactory drying. Moreover, bubbles are easily involved in a coating bead part when the curtain is applied to the web. This results in inclusion of bubbles in the coated liquid and the streaks and unevenness of the coated surface. Therefore, the coated surface cannot be uniform. In particular, the pool of the coating liquid falls onto the web, and this results in a pool of the coating liquid (commonly called "heel") at the upstream of the contact line between the web and the curtain. Bubbles are easily involved in the heel.

To address these problems, U.S. Pat. No. 4,851,268 discloses a deflector having a plurality of lips at the end thereof; Japanese Patent Provisional Publication No. 4-61951 discloses a deflector having a doglegged lip at the end thereof; Japanese Patent Provisional Publication No. 2-277570 discloses an deflector that is made of hydrophobic material; and Japanese Patent Provisional Publication No. 8-89886 discloses a method of starting the coating with a small amount of coating liquid and then immediately increasing the amount of the supplied coating liquid.

The deflectors disclosed by U.S. Pat. No. 4,851,268, Japanese Patent Provisional Publication No. 4-61951 and Japanese Patent Provisional Publication No. 2-277570 cannot prevent the web from being thickly coated or prevent the bubbles from being involved in the coating liquid if the coating is performed at a high speed. Thus, the uniform coating film cannot be formed on the surface of the web.

The method of Japanese Patent Provisional Publication No. 8-89886 cannot solve the problem in which the bubbles are involved in the coating liquid just after the coating. Moreover, the web cannot be coated uniformly since the bubbles are involved in the coating liquid due to a rapid increase in the amount of the supplied coating liquid.

This problem occurs not only at the start of the coating but at the end of the coating, but no measure has been taken at the end of the coating.

SUMMARY OF THE INVENTION

In view of the foregoing, it is an object of the present invention to provide a curtain coating apparatus and method, which prevent the surface of a support from being thickly coated and prevent bubbles from being involved in the coating liquid at the start of the coating to thereby immediately start forming a uniform coated surface, and which finishes the coating under stable conditions.

To achieve the above-mentioned object, the present invention is directed to a curtain coating apparatus, comprising: a coating hopper from which a curtain of a coating liquid free-falls; and a deflector having a receding part at the end thereof, the deflector receiving the curtain of the coating liquid to prevent a continuously-running support from being coated with the coating liquid before a start of coating, the deflector being moved relatively to the coating hopper at the start of the coating so that the curtain of the coating liquid can start to be applied to the support.

According to the present invention, the deflector has the receding part at the end thereof, and the receding part captures a pool of the coating liquid formed on the deflector before the start of the coating. This prevents the pool of the coating liquid from being applied to the support at the start of the coating and prevents the surface of the support from being coated too thick at the start of the coating.

To achieve the above-mentioned object, the present invention is directed to a curtain coating apparatus, comprising: a coating hopper from which a curtain of a coating liquid free-falls; and a deflector having a fine uneven part and a weir at the end thereof, the deflector receiving the curtain of the coating liquid to prevent a continuously-running support from being coated with the coating liquid before a start of coating, the deflector being moved relatively to the coating hopper at the start of the coating so that the curtain of the coating liquid can start to be applied to the support.

According to the present invention, the fine uneven part and the weir are formed at the end of the deflector in order to capture the pool of the coating liquid formed on the deflector before the start of the coating. This prevents the surface of the support from being coated too thick at the start of the coating.

According to the present invention, at least the end of the deflector is made of a water repellant material. This reduces the formation of the pool, and if the pool is formed, the receding part or the uneven part and the weir capture it. This effectively prevents the surface of the support from being coated too thick at the start of the coating.

According to the present invention, the minimum gap between the deflector and the support is no more than 5 mm at the start of the coating. This effectively prevents the curtain from being disturbed and prevents bubbles from being involved in the coating liquid while the free-falling curtain of the coating liquid starts to be applied to the support.

To achieve the above-mentioned object, the present invention is directed to a curtain coating method, comprising the steps of: forming a curtain of a coating liquid free-falling from a coating hopper; receiving the curtain of a coating liquid by a deflector to prevent a support continuously-running from being coated with the coating liquid before a start of coating; and moving the deflector relatively to the coating hopper to start a coating so that the curtain of the coating liquid can start to be applied to the support; wherein at the start of the coating when the curtain starts to be applied to the support, an electric charge is applied to the support so that an electric potential of a surface of the support to be coated can be 1–2.5 kV, and after the start of the coating, the electric charge applied to the support is gradually decreased so that the electric potential can be 0–1 kV.

According to the present invention, the electric charge is applied to the support so that the electric potential of the surface of the support can be 1–2.5 kV at the start of the coating. This prevents the involution of bubbles in the coating liquid, and the regular coating can be started immediately so that a uniform coating surface can be formed on the support. After the start of the coating, the electric charge applied to the support is decreased gradually so that the electric potential can be 0–1 kV. This prevents the disturbance of the curtain due to a rapid change of the electric charge. Therefore, the support can be coated uniformly since bubbles are not involved in the coating liquid from the start of coating to the regular coating and during the regular coating.

To achieve the above-mentioned object, the present invention is directed to a curtain coating method, comprising the steps of: forming a curtain of a coating liquid free-falling from a coating hopper; receiving the curtain of a coating liquid by a deflector to prevent a support continuously-running from being coated with the coating liquid before a start of coating; and moving the deflector relatively to the coating hopper to start a coating so that the curtain of the coating liquid can start to be applied to the support; wherein an electric charge is applied to the surface of the support just before an end of the coating, or wherein if the coating liquid is applied to the support after an electric charge is applied to the surface of the support, the amount of the electric charge is increased so that an electric potential of the surface can become higher than in a case wherein the electric charge is applied to the support just before the start of the coating.

According to the present invention, if the electric charge is applied to the surface of the support just before the end of the coating or if the coating liquid is applied to the support after the electric charge is applied to the surface of the support, the amount of the electric charge is increased so that the electric potential of the surface can become higher than in the case wherein the electric charge is applied to the support just before the start of the coating. Consequently, the coating can be finished under stable conditions.

To achieve the above-mentioned object, the present invention is directed to a curtain coating method, comprising the steps of: forming a curtain of a coating liquid free-falling from a coating hopper; receiving the curtain of a coating liquid by a deflector to prevent a support continuously-running from being coated with the coating liquid before a start of coating; and moving the deflector relatively to the coating hopper to start a coating so that the curtain of the coating liquid can start to be applied to the support; wherein an amount of the coating liquid supplied at the start of the coating when the curtain starts to be applied to the support is less than a set value in a regular coating, and a ratio of the amount of the supplied coating liquid to a running speed of the support at the start of the coating is between 0.6 and 1.0 of the ratio in the regular coating, and then the amount of the coating liquid supplied is gradually increased for at least five seconds up to the set value in the regular coating in such a manner that the ratio can be maintained within 0.6 and 1.0 of the ratio in the regular coating.

To achieve the above-mentioned object, the present invention is directed to a curtain coating method, comprising the steps of: forming a curtain of a coating liquid free-falling from a coating hopper; receiving the curtain of a coating liquid by a deflector to prevent a support continuously-running from being coated with the coating liquid before a start of coating; and moving the deflector relatively to the coating hopper to start a coating so that the curtain of the coating liquid can start to be applied to the support; wherein an amount of the coating liquid supplied and a running speed of the support at the start of the coating when the curtain starts to be applied to the support are less than set values in a regular coating, respectively, and a ratio of the amount of the supplied coating liquid to the running speed of the support at the start of the coating is between 0.6 and 1.0 of the ratio in the regular coating, and then the amount of the coating liquid supplied and the running speed are gradually increased for at least five seconds up to the set values in the regular coating, respectively, in such a manner that the ratio can be maintained within 0.6 and 1.0 of the ratio in the regular coating.

According to the present invention, the amount of the coating liquid supplied at the start of the coating when the curtain starts to be applied to the support or the amount of the coating liquid supplied and the running speed of the support is less than a set value in a regular coating, and the ratio of the amount of the supplied coating liquid to the running speed of the support at the start of the coating is between 0.6 and 1.0 of the ratio in the regular coating, and then the amount of the coating liquid supplied or the amount of the coating liquid supplied and the running speed is gradually increased for five seconds or more up to the set value in the regular coating in such a manner that the ratio can be maintained within the appropriate range. Consequently, the coating liquid is not disturbed at the start of the regular coating.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENT

This invention will be described in further detail by way of example with reference to the accompanying drawings.

Figure 1:
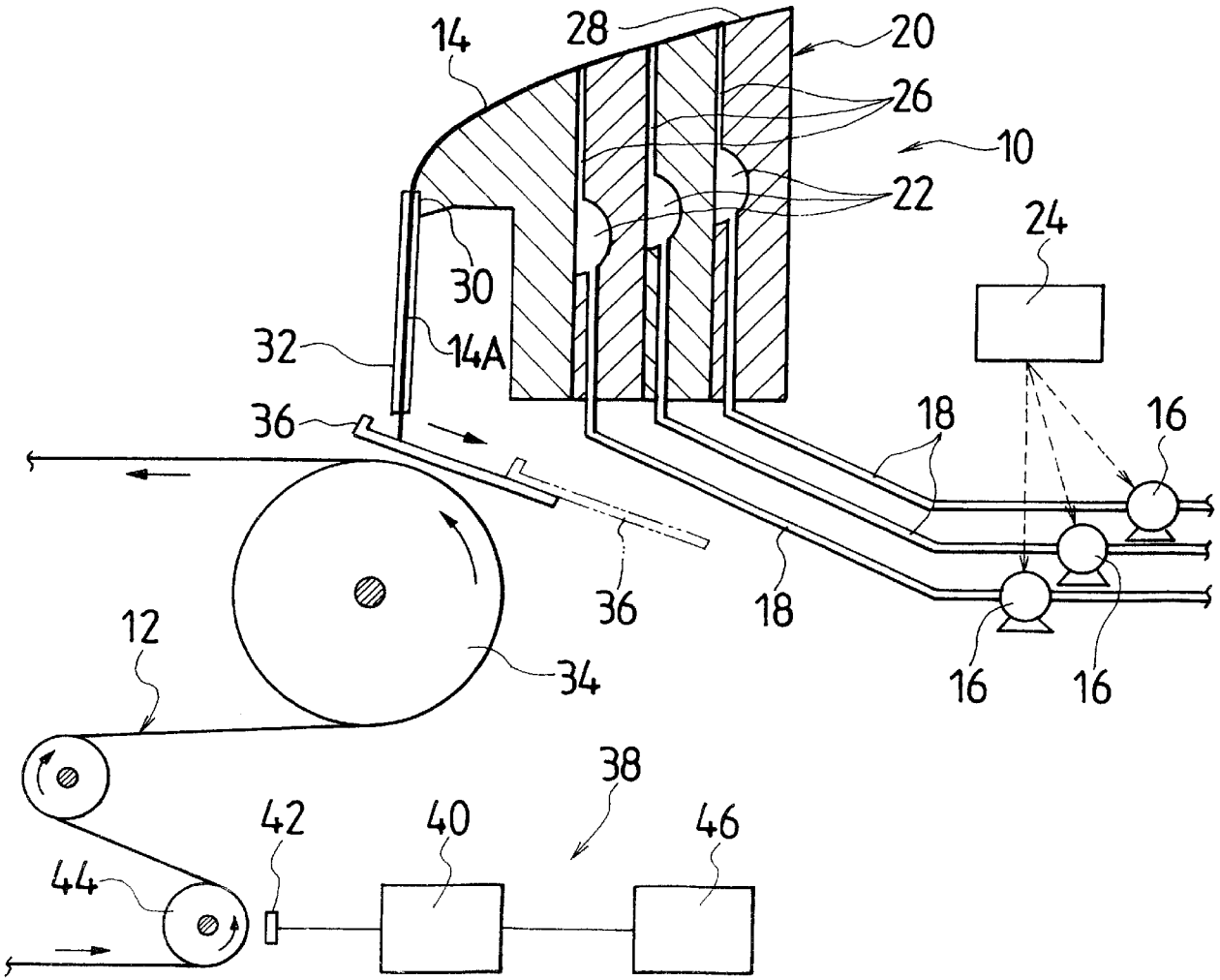
FIG. 1 is a view showing the entire structure of a curtain coating apparatus according to the present invention.

The present invention may be applied to all kinds of coating apparatuses, which coat a continuously-moving web with a free-falling curtain of coating liquid by making the curtain impinge on the web. In this embodiment, a slide hopper type curtain coating apparatus will be described with reference to FIG. 1. FIG. 1 shows an example wherein a web 12 is coated with a coating liquid 14 in three layers.

As shown in FIG. 1, liquid supply pumps 16 supply the coating liquid 14 to manifolds 22 of a coating hopper 20 through supply pipes 18 from coating liquid tanks (not shown). A control unit 24 controls the liquid supply pumps 16 in the amount of liquid supplied, a timing and speed for changing the amount of liquid supplied, and the like. The coating liquid 14 supplied to the manifolds 22 is diffused in order to have a predetermined coating width, and then, the coating liquid 14 is pushed onto a slide surface 28, which is inclined downward at the top of the coating hopper 20, through slits (or slots) 26. Then, the coating liquid 14 flows down on the slide surface 28 and free-falls from a lip end 30 to form a curtain 14A. A pair of edge guides 32, which are arranged oppositely, regulates the width of the free-falling curtain 14A at both ends.

Then, the curtain 14A of the coating liquid 14 impinges on the running web 12, which is guided onto and around a backup roller 34, to coat the web 12 with the coating liquid 14.

Prior to the start of coating, the coating liquid 14 flows down on a deflector 36, which is disposed in such a way as to block the curtain 14A of the coating liquid 14, in order to prevent the web 12 from being coated with the coating liquid 14. A container (not shown) receives the coating liquid 14 flowing down on the deflector 36. At the start of the coating, the deflector 36 is moved relatively to the coating hopper 20 so that the deflector 36 can be moved away from the curtain 14A. Consequently, the curtain 14A of the coating liquid 14 impinges on the web 12, and this starts the coating of the web 12 with the coating liquid 14. Likewise, at the end of the coating, the deflector 36 is moved relatively to the coating hopper 20 in order to block the curtain 14A. The deflector 36 may be slid or rotated. The deflector 36 is preferably moved relatively to the coating hopper 20 at a speed of 20–350 mm/sec. In the preparation for the coating, the coating hopper 20 is kept back to prevent the web 12 from being coated with the coating liquid 14.

Figure 2:
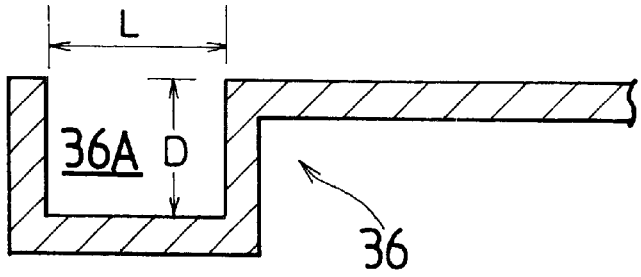
FIG. 2 is a sectional view showing the shape of a deflector used in the curtain coating apparatus according to the present invention.
Figure 3:
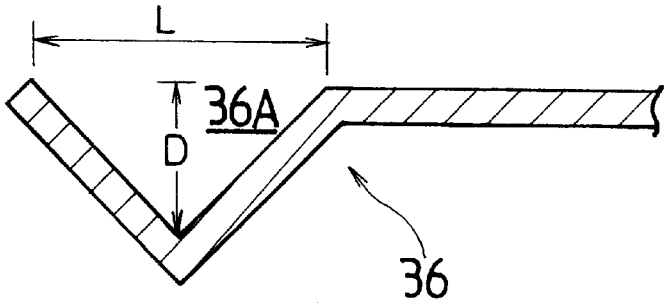
FIG. 3 is a sectional view showing another shape of the deflector.
Figure 4:
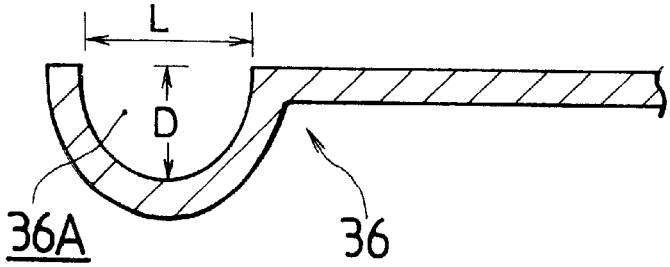
FIG. 4 is a sectional view showing another shape of the deflector.
Figure 5:
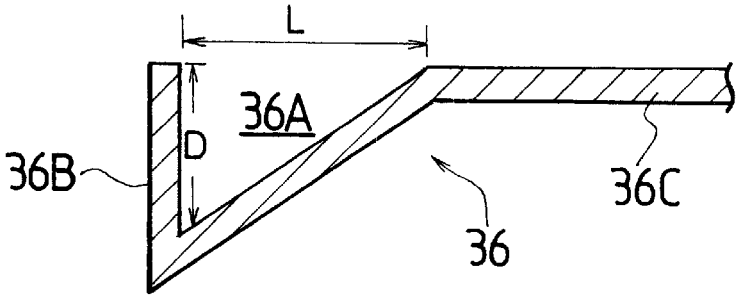
FIG. 5 is a sectional view showing another shape of the deflector.
Figure 6:
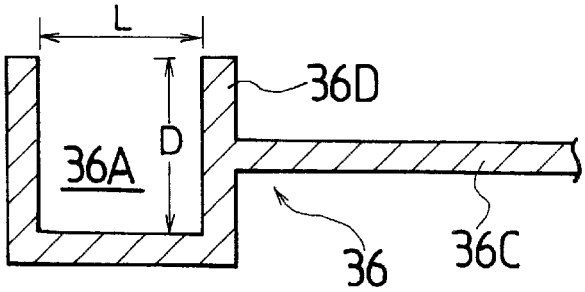
FIG. 6 is a sectional view showing another shape of the deflector.
Figure 7:
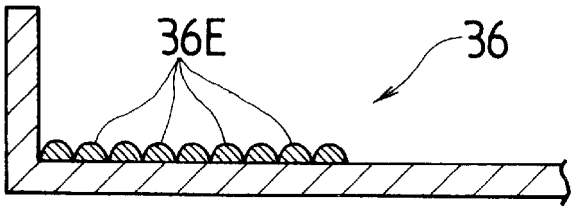
FIG. 7 is a sectional view showing another shape of the deflector.

FIGS. 2–7 are sectional views showing the shapes of the deflector 36 used in the curtain coating apparatus 10 according to the present invention, FIGS. 2–6 show a receding part 36A formed at the end of the deflector 36. FIG. 2 shows a rectangular section of the receding part 36A, FIG. 3 shows a triangular section of the receding part 36A, and FIG. 4 shows a curved section of the receding part 36A. FIG. 5 shows a modified example of FIG. 3, in which a side wall 36B of the receding part 36A is perpendicular to a flow-down part 36C, which lets the coating liquid flow down. FIG. 6 shows a modified example of FIG. 2, in which a weir 36D is formed between the receding part 36A and the flow-down part 36C. In FIGS. 2–6, the receding part 36A preferably has a length (L) of 3–15 mm and a depth (LI) of 3–10 mm. In FIG. 7, a fine uneven part 36E, referred to as abutting rounded projections, is formed at the end of the L-shaped deflector 36, which has a weir at the end thereof. The end of the deflector 36 is preferably made of a water-repellant material or is coated with a water-repellant finish; for example, the end of the deflector 36 is made of Teflon® or is coated with a Teflon® finish.

As stated above, the receding part 36A is formed at the end of the deflector 36, which captures a pool formed on the deflector 36 receiving the curtain 14A of the coating liquid 14 prior to the start of coating. This prevents the pool from being transferred to the web 12 at the start of the coating. This prevents the web 12 from being coated thickly at the start of the coating.

Similarly, the L-shaped deflector 36 having the fine uneven part 36E at the end thereof, the weir and the uneven part 36E can capture the pool, which is formed on the deflector 36 prior to the start of the coating. This prevents the web 12 from being coated thickly at the start of the coating.

The minimum gap between the deflector 36 and the web 12 is preferably no more than 5 mm at the start of the coating. This eliminates the disturbance of the curtain 14A when the free-falling curtain 14A is started to be applied to the web 12 and also reduces the shock generated when the curtain 14A impinges on the web 12 to prevent the involution of bubbles in the coating liquid 14. This prevents the coated surface of the web 12 from being uneven and streaked.

As shown in FIG. 1, the curtain coating apparatus 10 according to the present invention has corona discharge equipment 38 for applying a unipolar electric charge to the web 12. More specifically, a high voltage generator 40 applies a high voltage between an electrode 42 and a discharge roller 44 to electrify the surface to be coated of the web 12. A control part 46 controls the high voltage generator 40 in the amount of the voltage applied, the timing and speed for changing the voltage. An electrification voltage measuring apparatus (not shown) measures the electrification voltage of the surface of the web 12, and the electrification voltage can be fed back to the control part 46. The high voltage may also directly be applied to the backup roller 34 to thereby produce an electrostatic field between the coating hopper 20 and the backup roller 34.

When the curtain 14A is started to be applied to the web 12 at the start of the coating, the corona discharging equipment 38 applies the electric charge to the web 12 so that the electric potential of the surface of the web 12 can be 1–2.5 kV. After the start of coating, the electric charge applied to the web 12 is decreased gradually so that the electric potential of the surface can be 0–1 kV. If the electric charge is applied to the surface of the web 12 just before the end of the coating or the coating liquid is applied to the web 12 after the electric charge is applied to the surface, the quantity of the electric charge is increased so that the electric potential of the surface can become higher than in the case wherein the electric charge is applied to the web 12 just before the start of the coating.

As stated above, the electric charge is applied to the web 12 so that the electric potential of the surface of the web 12 can be 1–2.5 kV at the start of the coating, and after the start of the coating, the electric charge applied to the web 12 is decreased gradually so that the electric potential of the surface can be 0–1 kV. This prevents the involution of the bubbles in the coating liquid 14. A regular coating can be started immediately so that a uniform coated surface can be formed. After the start of the coating, the electric charge applied to the web 12 is gradually decreased so that the electric potential of the surface can be 0–1 kV. This prevents the disturbance of the curtain 14A due to a rapid change of the electric charge. Therefore, the web 12 can be coated uniformly from the start of coating to the regular coating. If the electric potential of the surface is 1 kV or more at the regular coating, the coated surface deteriorates due to the unevenness of the electric charge. For this reason, it is necessary to decrease the electric charge applied to the web 12 after the start of coating. If the electric charge is decreased instantaneously, the curtain 14A is easily disturbed and this results in the nonuniform coating. Thus, the electric charge is gradually decreased in five seconds or more, and more preferably in ten seconds or more according to the present invention.

According to the present invention, the amount of the coating liquid supplied at the start of the coating when the curtain 14A starts to be applied to the web 12 is less than a set value in the regular coating, or the amount of the coating liquid supplied and a running speed of the web 12 are less than set values in the regular coating, respectively. In addition, the ratio of the amount of the supplied coating liquid to the running speed of the web 12 at the start of the coating is between 0.6 and 1.0 of the ratio in the regular coating. The amount of the coating liquid supplied is gradually increased for five seconds or more up to the set value in the regular coating in such a manner that the ratio can be maintained within the appropriate range, or the amount of the coating liquid supplied and the running speed is gradually increased for five seconds or more up to the set values in the regular coating, respectively, in such a manner that the ratio can be maintained within the appropriate range. Consequently, the coating can be finished under stable conditions.

The amount of the coating liquid 14 supplied, the running speed of the web 12 and the ratio of the amount of the coating liquid 14 to the running speed are controlled according to the relationship of the start of the coating and the set values in the regular coating. This prevents the web 12 from being coated thickly at the start of the coating when the curtain 14A of the coating liquid 14 starts to be applied to the web 12. After the start of coating, the amount of the coating liquid supplied or the amount of the coating liquid supplied and the running speed of the web are gradually increased to the set value in the regular coating for five seconds or more to the set values in the regular coating in such a manner that the ratio can be maintained within the appropriate range. This enables the regular coating to start smoothly. If the amount of the coating liquid supplied and the running speed are changed rapidly after the coating starts with the amount of the coating liquid and at the running speed, which are different from the set values in the regular coating; the curtain 14A is easily disturbed. Thus, it is important to gradually change the amount of the coating liquid 14 supplied and the running speed of the web 12. It is also important to synchronously change the amount of the coating liquid 14 supplied and the running speed of the web12 by maintaining the ratio within the appropriate range. In the case of the multi-layer coating, the amount of the coating liquid 14 supplied to the multiple layers may be changed at the same rate to finally become the set values in the regular coating. Alternatively, the amount of the coating liquid supplied to the multiple layers may be changed at different rates in view of the retentivity and replaceability of the coating liquid 14 in each layer. Since the curtain 14 is easily disturbed by a rapid change, the amount of the coating liquid 14 supplied and the running speed of the web 12 should be gradually changed to the set values for five seconds or more. If they are changed for a long time, the loss of the products is increased. For this reason, it is necessary to immediately change the amount of the coating liquid 14 supplied and the running speed of the web 12 to the set values as long as the curtain 14 is not disturbed.

A variety of liquid compositions are used as the coating liquid 14 according to purposes. Examples of the coating liquid 14 are a coating liquid for forming a sensitive emulsion layer, an insensitive intermediate layer, a protective layer, a back layer, or the like for use in the manufacture of photosensitive material; a coating liquid for forming a magnetic layer, an undercoating layer, a smoothing layer, a protective layer, a back layer, or the like for use in the manufacture of magnetic recording material; a coating liquid for forming a layer composed mainly of micro capsules and a layer composed mainly of coloring material, or the like for use in the manufacture of information recording paper; and a coating liquid for forming a sensitive layer, a resin layer and a mat layer for use in the manufacture of presensitized offset plates.

The web (the support) 12 for use in the present invention is, for example, paper, plastic film, metal, resin-coated paper and synthetic paper. The plastic film is made of, for example, polyolefin, polyester and cellulose acetate. The resin used for the resin-coated paper is, for example, polyolefin such as polyethylene; however, it is not restricted to this. The metal web is made of aluminum for example. All kinds of web 12 may be undercoated.

EXAMPLE

A description will be given of an embodiment of the curtain coating apparatus and method according to the present invention.

The curtain coating apparatus was a slide hopper type as shown in FIG. 1, and it was provided with the corona discharging apparatus before the start of coating. The deflector had a receding part at the end thereof, and the section of the receding part was square as shown in FIG. 2.

Embodiment 1

A photosensitive material liquid for color printing paper was used as the coating liquid, and polyethylene coated paper was used as the web. The amount of the coating liquid applied to the web was 3.5 ml/cm·sec and the running speed of the web was 300 m/min.

At the start of the coating, the deflector was moved relatively to the coating hopper at a speed of 160 mm/sec, and the deflector was moved away from the curtain of the coating liquid to start the coating. At the start of the coating, the web was electrified so that the electric potential of the surface of the web to be coated was 2,000V, and the electric potential of the coated surface was decreased to 0V in ten seconds after the start of coating.

At the end of the coating, the web was electrified so that the electric potential of the coated surface was gradually increased from 0V to 2,000V. In this state, the deflector was moved relatively to the coating hopper at a speed of 260 mm/sec so that the deflector could block the curtain of the coating liquid.

Figure 8:
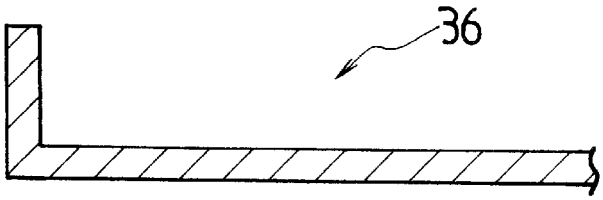
FIG. 8 PRIOR ART
FIG. 8 is a sectional view showing the shape of a conventional deflector.

In a comparative example, the conventional L-shaped deflector in FIG. 8 was used. The amount of the coating liquid supplied was 3.5 ml/cm·sec, and the running speed of the web was 300 m/min. The electric potential of the surface of the web was maintained at 500V and 2000V.

In the comparative example, the coated liquid of the thickly-coated part formed at the end of the web at the start of the coating was three or more times as thick as that of the regular part formed according to the set values in the regular coating. Consequently, the coated surface was dried unsatisfactorily at the drying step in the after treatment. If the electric potential of the surface of the web was maintained at 500V, bubbles were involved in the coating liquid just after the start of the coating. If the electric potential was 2000V, the bubbles were not involved in the coating liquid, but the regular part (which is to be a product) of the web was coated unevenly.

In the embodiment 1 of the present invention, the coated liquid of the thickly-coated part formed at the end of the web at the start of the coating was two times or less as thick as that of the regular part formed according to the set values in the regular coating. The bubbles were not involved in the coating liquid after the start of the coating, and the coated surface was not uneven or streaked. Moreover, the coated surface did not have streaks due to the involution of the bubbles at the start of the regular coating and at the end of the coating. The coating was finished under stable conditions.

As stated above, it was proved that the curtain coating method of the present invention could prevent the surface of the web from being coated too thick and prevents the involution of the bubbles at the start of the coating even if the web moves at a high speed and the stable coating could be started immediately to form the uniform coating surface.

Embodiment 2

In the embodiment 2, the same coating liquid and deflector were used as in the embodiment 1. The amount of the coating liquid supplied was 2 ml/cm·sec and the running speed of the web was 250 m/min.

At the start of the coating, the electric potential of the surface of the web was raised to 1500V. Then, the electric potential of the surface was lowered to 600V in 15 seconds. At the same time, the amount of the coating liquid supplied and the running speed of the web were increased to 4 ml/cm·sec and 360 m/min at constant rates, respectively, which were the set values in the regular coating. The relative moving speed of the coating hopper and the deflector was 160 mm/sec as in the embodiment 1.

A comparative example in the embodiment 2 was the same as in the embodiment 1.

Consequently, in the embodiment 2 of the present invention, the coated liquid of the thickly-coated part formed at the end of the web at the start of the coating was 1.7 times or less as thick as that of the regular part formed according to the set values in the regular coating, and the embodiment 2 achieved a more favorable effect than the embodiment 1. The bubbles were not involved in the coating liquid and the coated surface was not streaked if the amount of the coating liquid supplied and the running speed of the web were changed at the start of the regular coating. In this case, the end of the web, which is not used as a product, is 100 m long, which is half of that in the comparative example.

As set forth hereinabove, the curtain coating apparatus and method of the present invention prevent the surface of the web from being coated too thick and prevents the involution of the bubbles at the start of the coating; enables the immediate start of the stable coating for forming the uniform coating surface; and finishes the coating under stable conditions.

Accordingly, the loss of the products can be decreased, and the quality of the coating can be improved.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A curtain coating apparatus, comprising:

a coating hopper from which a curtain of a coating liquid free-falls; and a deflector having a depression at an end thereof, said depression which extends below a plane of a bottom surface of the deflector, the deflector receiving the curtain of the coating liquid to prevent a continuously-running support from being coated with the coating liquid before a start of coating, the deflector being moved relatively to the coating hopper at the start of the coating so that the curtain of the coating liquid can start to be applied to the support.

2. The curtain coating apparatus as defined in claim 1, wherein a minimum gap between the deflector and the support is no more than 5 mm at the start of the coating.

3. The curtain coating apparatus as defined in claim 1, wherein at least the end of the deflector is made of a water repellant material.

4. The curtain coating apparatus as defined in claim 3, wherein a minimum gap between the deflector and the support is no more than 5 mm at the start of the coating.

5. The curtain coating apparatus as defined in claim 1, further comprising:

a charge applying device which applies an electric charge to the support, wherein: the curtain of the coating liquid free-falling from the coating hopper is formed;

then, the curtain of the coating liquid is received by the deflector to prevent the support from being coated with the coating liquid before a start of coating;

then, the deflector is moved relatively to the coating hopper to start a coating so that the curtain of the coating liquid can start to be applied to the support; and at the start of the coating when the curtain starts to be applied to the support, an electric charge is applied to the support by the charge applying device so that an electric potential of a surface of the support to be coated can be 1–2.5 kV, and after the start of the coating, the electric charge applied to the support is gradually decreased so that the electric potential can be 0–1 kV.

6. The curtain coating apparatus as defined in claim 1, further comprising:

a charge applying device which applies an electric charge to the support, wherein:

the curtain of the coating liquid free-falling from the coating hopper is formed;

then, the curtain of the coating liquid is received by the deflector to prevent the support continuously-running from being coated with the coating liquid before a start of coating;

then, the deflector is moved relatively to the coating hopper to start a coating so that the curtain of the coating liquid can start to be applied to the support;

then, an electric charge is applied to the surface of the support by the charge applying device just before an end of the coating; and then, the deflector is moved relatively to the coating hopper to receive the curtain of the coating liquid to end the coating.

7. The curtain coating apparatus as defined in claim 1, further comprising:

a charge applying device which applies an electric charge to the support, wherein:

the curtain of the coating liquid free-falling from the coating hopper is formed;

then, the curtain of the coating liquid is received by the deflector to prevent the support continuously-running from being coated with the coating liquid before a start of coating;

then, the deflector is moved relatively to the coating hopper to start a coating so that the curtain of the coating liquid can start to be applied to the support;

during the coating, an electric charge is applied to the surface of the support by the charge applying device;

then, the amount of the electric charge is increased just before an end of the coating so that an electric potential of the surface can become higher than an electric potential of the surface during the coating; and then, the deflector is moved relatively to the coating hopper to receive the curtain of the coating liquid to end the coating.

8. The curtain coating apparatus as defined in claim 1, wherein:

the curtain of the coating liquid free-falling from the coating hopper is formed;

then, the curtain of the coating liquid is received by the deflector to prevent the support from being coated with the coating liquid before a start of coating;

then, the deflector is moved relatively to the coating hopper to start a coating so that the curtain of the coating liquid can start to be applied to the support; and an amount of the coating liquid supplied at the start of the coating when the curtain starts to be applied to the support is less than a set value in a reference coating, and a ratio of the amount of the supplied coating liquid to a running speed of the support at the start of the coating is between 0.6 and 1.0 of the ratio in the reference coating, and then the amount of the coating liquid supplied is gradually increased for at least five seconds up to the set value in the reference coating in such a manner that the ratio can be maintained within 0.6 and 1.0 of the ratio in the reference coating.

9. The curtain coating apparatus as defined in claim 1, wherein:

the curtain of the coating liquid free-falling from the coating hopper is formed;

then, the curtain of the coating liquid is received by the deflector to prevent the support from being coated with the coating liquid before a start of coating;

then the deflector is moved relatively to the coating hopper to start a coating so that the curtain of the coating liquid can start to be applied to the support; and an amount of the coating liquid supplied and a running speed of the support at the start of the coating when the curtain starts to be applied to the support are less than set values in a reference coating, respectively, and a ratio of the amount of the supplied coating liquid to the running speed of the support of the coating is between 0.6 and 1.0 of the ratio in the reference coating, and then the amount of the coating liquid supplied and the running speed are gradually increased for at least five seconds up to the set values in the reference coating, respectively, in such a manner that the ratio can be maintained within 0.6 and 1.0 of the ratio in the reference coating.

10. A curtain coating apparatus, comprising:

a coating hopper from which a curtain of a coating liquid free-falls; and a deflector having a weir at an end thereof, the deflector further having an upward facing interior surface, with abutting rounded projections being disposed on said upward facing interior surface at said end of the deflector, the deflector receiving the curtain of the coating liquid to prevent a continuously-running support from being coated with the coating liquid before a start of coating, the deflector being moved relatively to the coating hopper at the start of the coating so that the curtain of the coating liquid can start to be applied to the support.

11. The curtain coating apparatus as defined in claim 10, wherein a minimum gap between the deflector and the support is no more than 5 mm at the start of the coating.

12. The curtain coating apparatus as defined in claim 10, wherein at least the end of the deflector is made of a water repellant material.

13. The curtain coating apparatus as defined in claim 12, wherein a minimum gap between the deflector and the support is no more than 5 mm at the start of the coating.

* * * * *